US009155132B2

(12) United States Patent
Cheung

(10) Patent No.: US 9,155,132 B2
(45) Date of Patent: Oct. 6, 2015

(54) MICROWAVE CONTAINER

(71) Applicant: Chak Hong Gary Cheung, Hong Kong (HK)

(72) Inventor: Chak Hong Gary Cheung, Hong Kong (HK)

( * ) Notice: Subject to any disclaimer, the term of this patent is extended or adjusted under 35 U.S.C. 154(b) by 225 days.

(21) Appl. No.: 13/678,557

(22) Filed: Nov. 16, 2012

(65) Prior Publication Data

US 2014/0138376 A1 May 22, 2014

(51) Int. Cl.
*H05B 6/64* (2006.01)

(52) U.S. Cl.
CPC ..... *H05B 6/6408* (2013.01)

(58) Field of Classification Search
CPC ..... H05B 6/6408
USPC ..... 219/735; 220/4.21, 4.23, 23.83, 315, 220/359.2, 263, 480, 556, 676, 835; 99/323, 322
See application file for complete search history.

(56) References Cited

U.S. PATENT DOCUMENTS 5,337,910 A * 8/1994 Picozza et al. ..... 220/367.1
5,499,736 A * 3/1996 Kohl ..... 220/254.5
5,667,094 A * 9/1997 Rapchak et al. ..... 220/834
6,715,632 B2 * 4/2004 Baker ..... 220/835
2003/0024930 A1 * 2/2003 Smith et al. ..... 220/254.1
2003/0089714 A1 * 5/2003 Dart et al. ..... 220/254.3
2008/0073346 A1 * 3/2008 Zuares et al. ..... 220/254.3

FOREIGN PATENT DOCUMENTS

GB 2410494 8/2005

OTHER PUBLICATIONS

1st Office Action of counterpart New Zealand Application No. 617822 issued on Nov. 21, 2013.

* cited by examiner

*Primary Examiner* — Thien S Tran

(57) ABSTRACT

A microwave container includes a container body and a lid. The container body has a bottom wall, a sidewall extending upwardly from a periphery of the bottom wall and ending at a rim. The lid has a top wall, a sidewall extending downwardly from a periphery of the top wall and ending at a brim. The lid is formed with a vent opening. The flap includes a proximal portion hingedly connected to the brim of the lid by a living hinge and an outwardly extending distal portion formed with a plug, wherein the flap is movable between a free-hanging position where the flap is hanging freely from the brim of the lid and a closed position where the flap is flipped about the hinge over a side of the lid and the plug is plugged into the vent opening.

6 Claims, 12 Drawing Sheets

MICROWAVE CONTAINER

FIELD OF THE TECHNOLOGY

The present application relates to a microwave container.

BACKGROUND

Microwave containers are known in the prior art. A microwave container is used to contain food therein and can be placed inside a microwave oven for cooking or heating up the food. A vent opening is usually formed on the lid of the microwave container to allow the release of pressure and vapor that may be formed inside the microwave container during cooking or heating up of the food inside the microwave oven. Various mechanisms have been designed to open and close the vent opening of a microwave container. However, the conventional mechanisms for opening and closing the vent opening of a microwave container are complicated in structure. Hence, there is a need to provide an improved microwave container with a simple mechanism for opening and closing the vent opening.

The above description of the background is provided to aid in understanding a microwave container, but is not admitted to describe or constitute pertinent prior art to the microwave container disclosed in the present application, or consider any cited documents as material to the patentability of the claims of the present application.

SUMMARY

According to one aspect, there is provided a microwave container including a container body and a lid. The container body has a bottom wall and a sidewall extending upwardly from a periphery of the bottom wall and ending at a rim. The lid has a top wall and a sidewall extending downwardly from a periphery of the top wall and ending at a brim. The lid is formed with a vent opening. The lid may include a flap having a proximal portion hingedly connected to the brim of the lid by a hinge and an outwardly extending distal portion formed with a plug. The flap can be movable between a free-hanging position where the flap is hanging freely from the brim of the lid and a closed position where the flap is flipped about the hinge over a side of the lid and the plug is plugged into the vent opening.

The flap and the lid can be formed integrally in one single piece. The hinge can be a living hinge. The living hinge may have a transverse weakened portion about which the hinge can fold. The folding hinge may have two opposite sides with two rounded corners respectively.

The flap may have a corrugated shape conforming to an outer shape of the side of the lid. The proximal portion of the flap may have an S-shaped cross section configured to nest on top of the brim of the lid having a matching S-shaped cross section when the flap is at its closed position. The proximal portion of the flap may include a U-shaped sealing channel disposed adjacent to the hinge and configured to nest on top of a downwardly facing U-shaped sealing channel of the brim of the lid adjacent to the hinge, and a U-shaped reinforcing channel configured to nest on top of an upwardly facing U-shaped reinforcing channel of the brim of the lid adjacent to the sidewall thereof when the flap is at its closed position.

The U-shaped reinforcing channel of the flap may be integrally formed with a U-shaped transverse reinforcing web with two upper ends having upwardly diverging curved edges. The upwardly facing U-shaped reinforcing channel of the brim of the lid may be integrally formed with a plurality of U-shaped transverse reinforcing web with two upper ends having upwardly diverging curved edges.

The flap may include a planar portion formed between the proximal and distal portions of the flap, and configured to fit within a planar recess formed on the sidewall of the lid in such a manner that the outer surface of the planar portion of the flap is flush with adjacent outer surfaces of the lid when the flap is at its closed position. The flap may further include an arc portion formed between the planar portion and the distal portion of the flap, and configured to fit within an arc-shaped recess formed on an arched portion formed along the top periphery of the lid in such a manner that the outer surface of the arc portion of the flap is flush with adjacent outer surfaces of the lid when the flap is at its closed position.

The distal portion of the flap may be formed with a tab disposed in a recessed region formed on the top wall of the lid when the flap is at its closed position, and defining a gap to facilitate the insertion of a finger of a user therein in order to pull out the tab and disengage the plug from the vent opening.

In one embodiment, the container body and the lid are rectangular in shape, and the flap is hingedly connected to one side of a rectangular brim of the lid. In another embodiment, the container body and the lid are circular in shape, and the flap is hingedly connected to a circular brim of the lid.

Although the microwave container disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the microwave container disclosed in the present application will now be described by way of example with reference to the accompanying drawings wherein.

DETAILED DESCRIPTION

Figure 1:
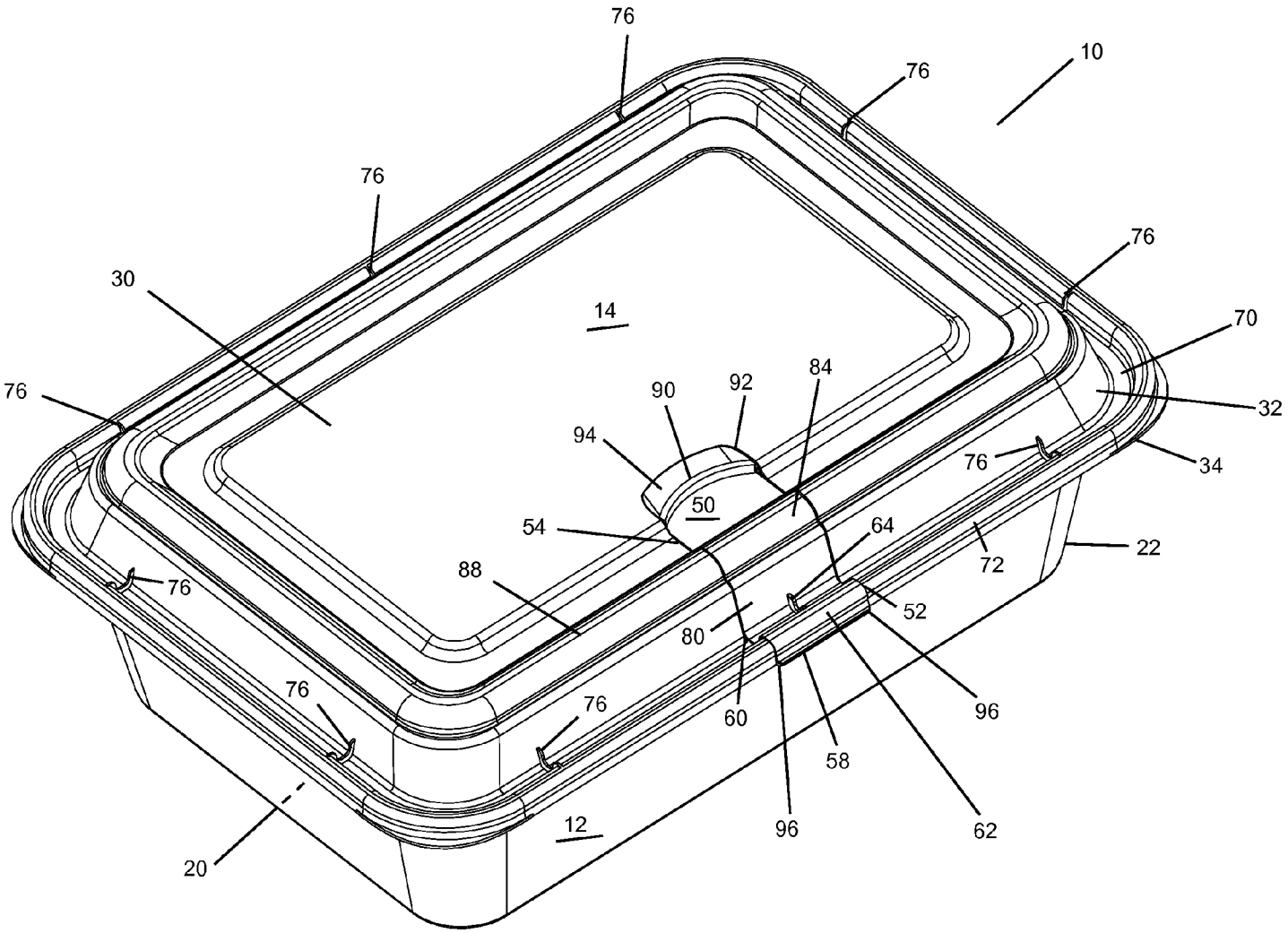
FIG. 1 is a top perspective view of a microwave container according to an embodiment of the present application.

Reference will now be made in detail to a preferred embodiment of the microwave container disclosed in the present application, examples of which are also provided in the following description. Exemplary embodiments of the microwave container disclosed in the present application are described in detail, although it will be apparent to those skilled in the relevant art that some features that are not particularly important to an understanding of the microwave container may not be shown for the sake of clarity.

Furthermore, it should be understood that the microwave container disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

Certain terminology is used in the following description for convenience only and is not limiting. The words "upwards", "downwards", "upper", "lower", "top", and "bottom" designate directions in the drawings to which reference is made. The terminology includes the words noted above as well as derivatives thereof and words of similar import.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

FIGS. 1-6 are various views of a microwave container 10 according to an embodiment of the present application. The microwave container 10 may include a container body 12 and a lid 14. According to the illustrated embodiment, the container body 12 and the lid 14 of the microwave container 10 are rectangular in shape.

The container body 12 may include a bottom wall 20, a sidewall 22 extending upwardly from a periphery of the bottom wall 20 and ending at a rim 24. The container body 12 can be used to hold food therein.

The lid 14 may include a top wall 30, a sidewall 32 extending downwards from a periphery of the top wall 30 and ending at a brim 34 configured to sealingly couple to the rim 24 of the lid 14. A vent opening 36 may be formed on the top wall 30 for the release of pressure and vapor that may be generated inside the microwave container 10 when the food therein is heated inside a microwave oven. The vent opening 36 may be circular in shape or in any other shape.

Figure 2:
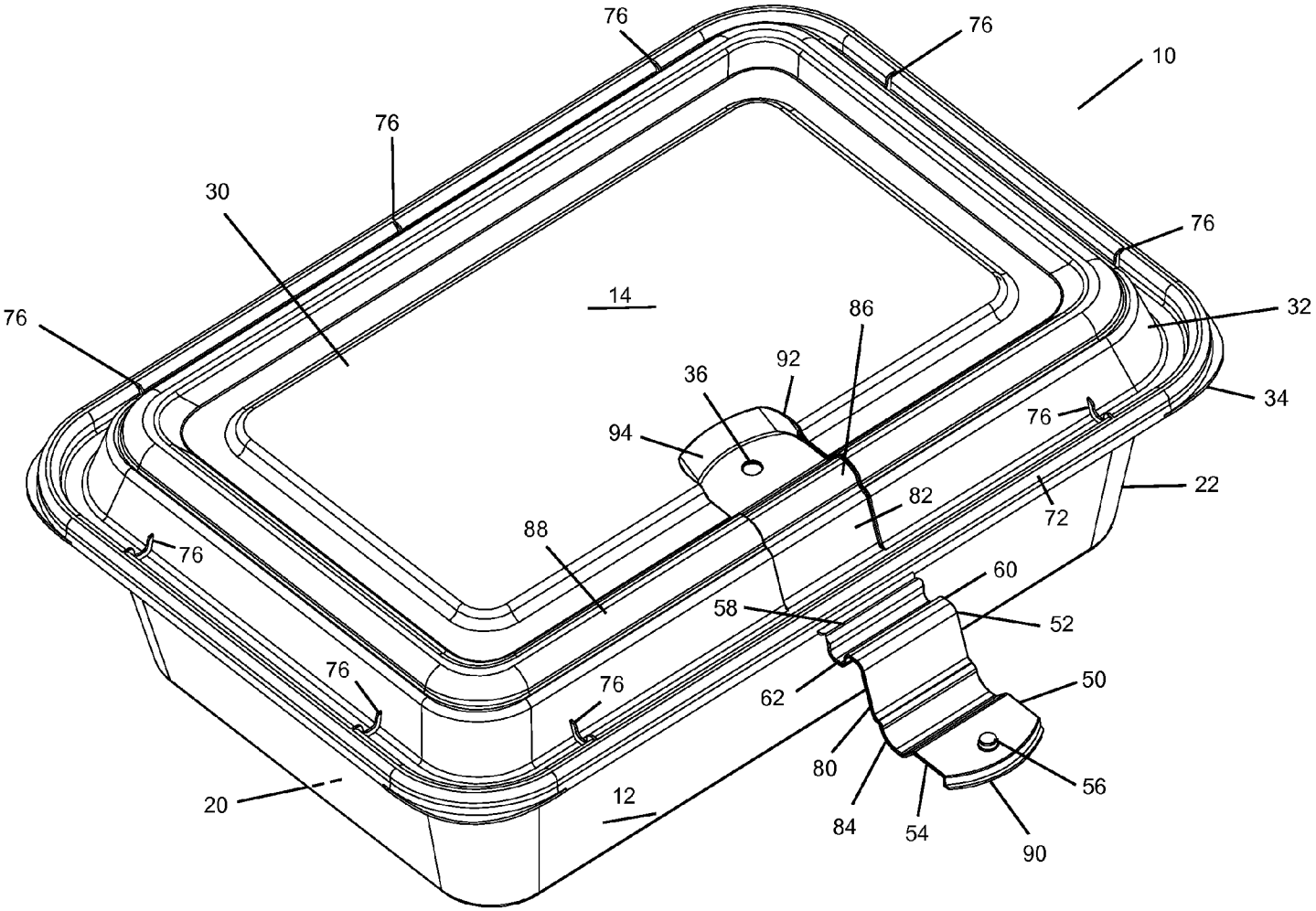
FIG. 2 is a top perspective view of the microwave container of FIG. 1 with a flap in a free-hanging position.
Figure 3:
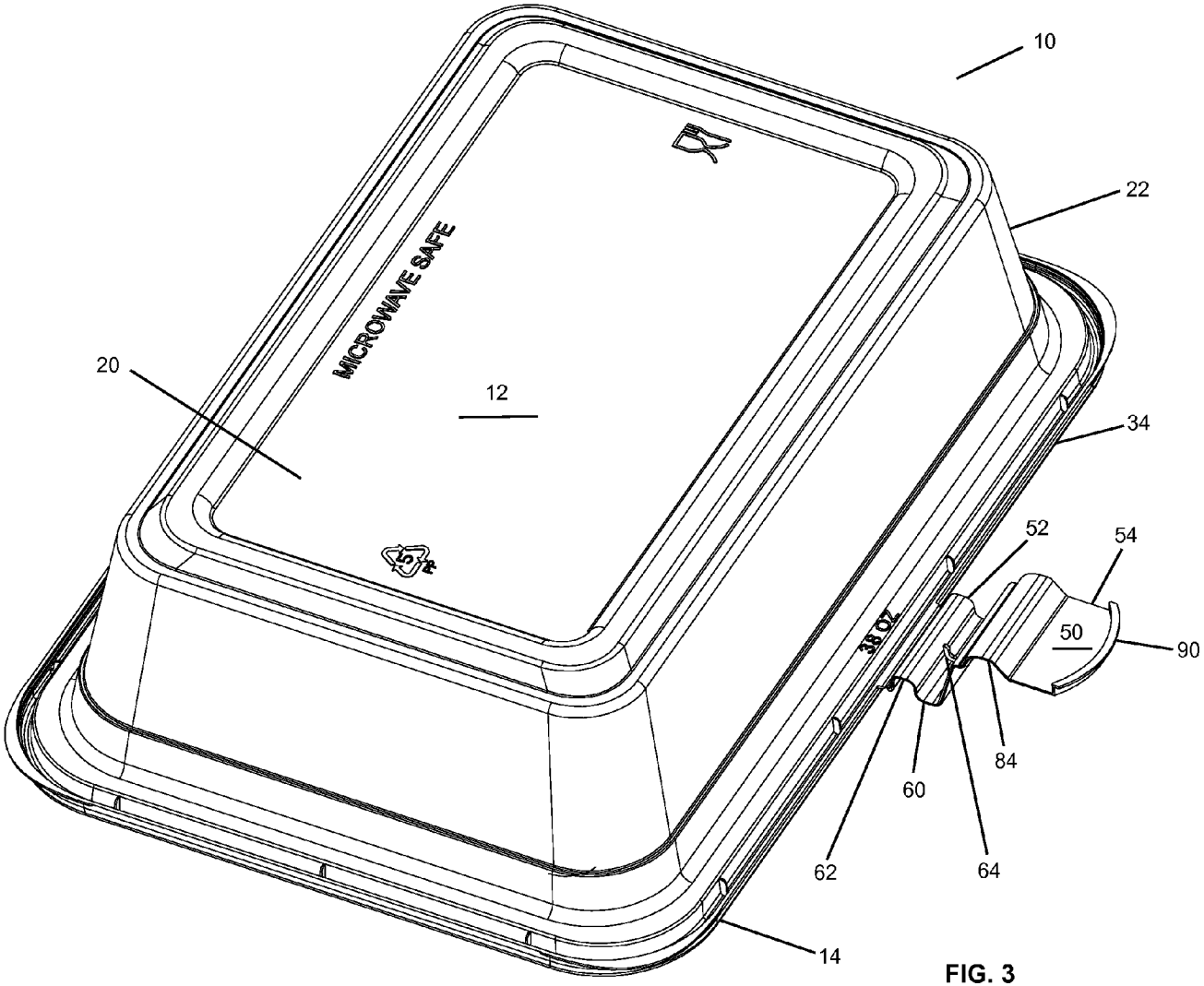
FIG. 3 is a bottom perspective view of the microwave container of FIG. 1 with the flap in the free-hanging position.
Figure 4:
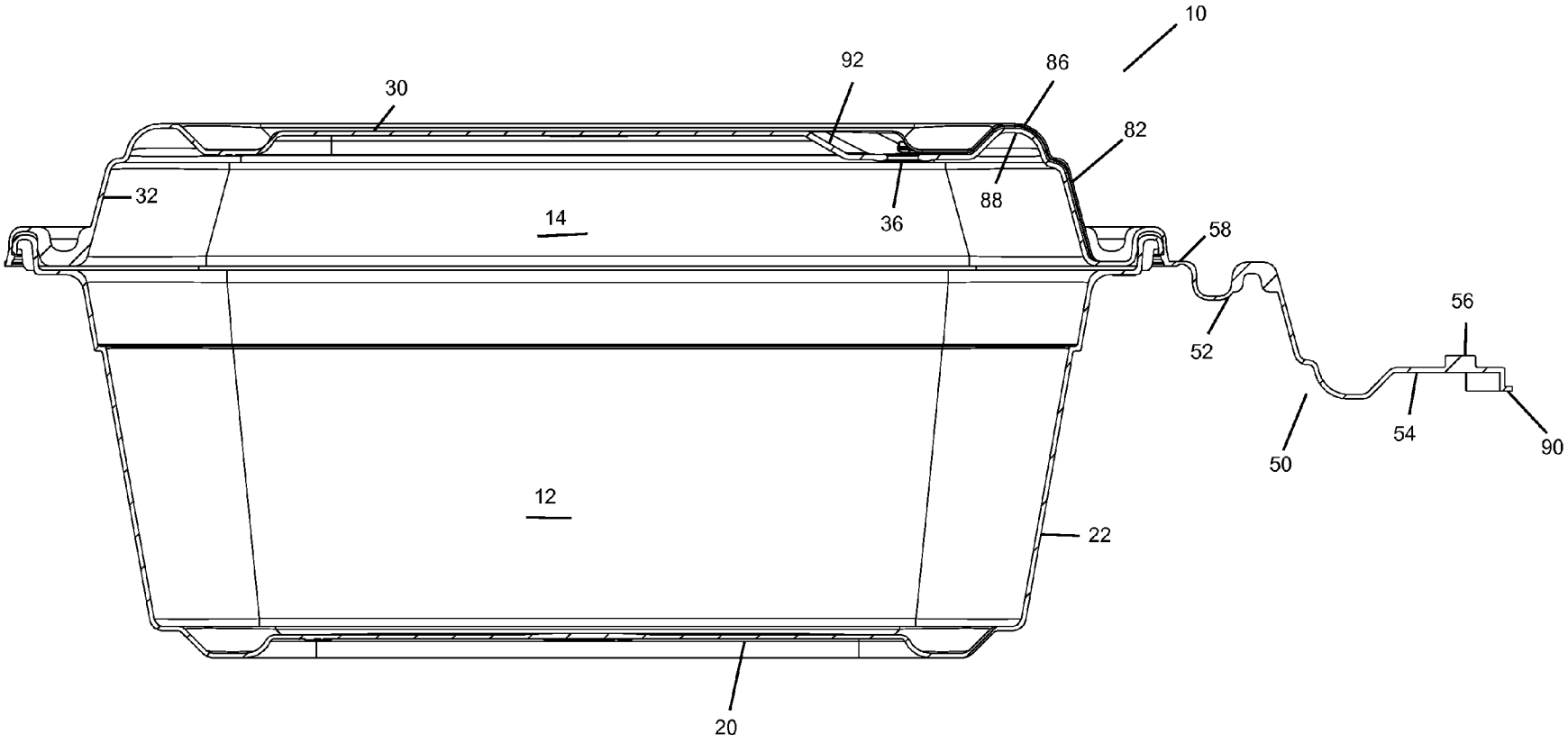
FIG. 4 is a cross sectional view of the microwave container of FIG. 1 with the flap in the free-hanging position.
Figure 5:
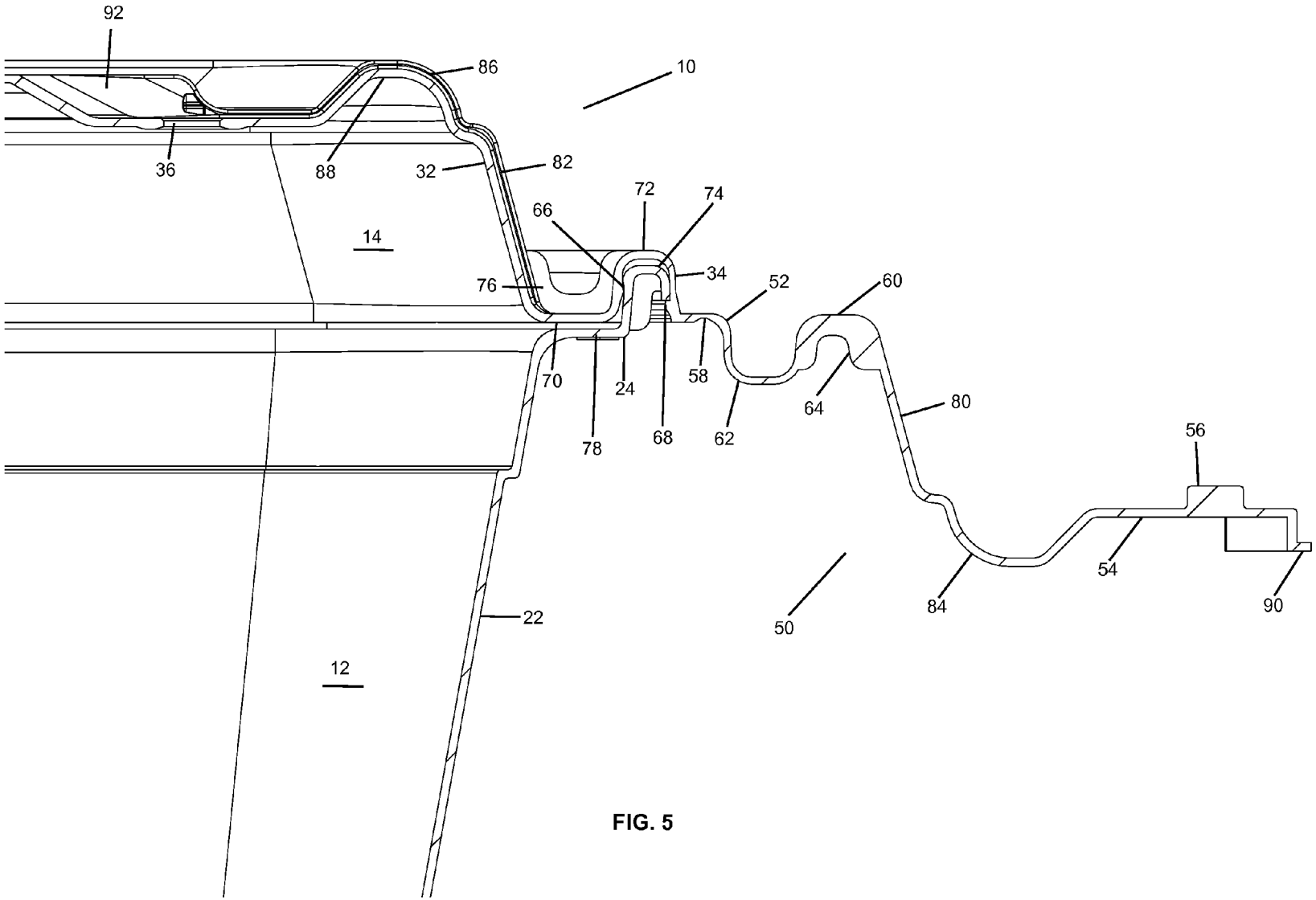
FIG. 5 is an enlarged cross sectional view of the microwave container of FIG. 4.
Figure 6:
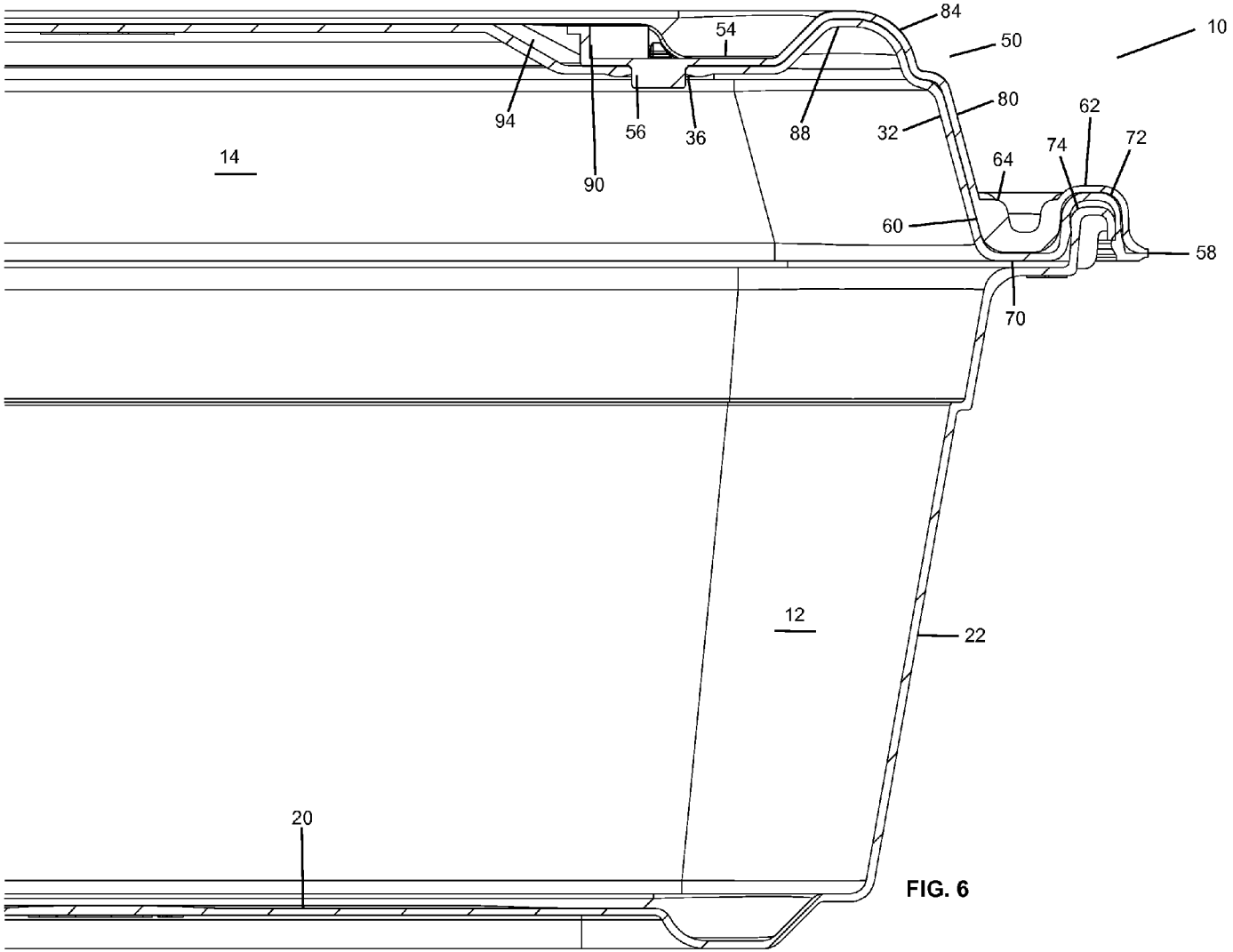
FIG. 6 is a cross sectional view of the microwave container of FIG. 1 with the flap in a closed position.

A flap 50 may be hingedly connected to the brim 34 of the lid 14 by a hinge 58. The hinge 58 may be a living hinge. The flap 50 can be movable between a free-hanging position, as depicted in FIG. 2, where the flap 50 is hanging freely from the brim 34 of the lid 14 and a closed position, as depicted in FIG. 1, where the flap 50 is flipped about the hinge 58 over a side of the lid 14 and the plug 56 is plugged into the vent opening 36 on the lid 14.

The flap 50 can be integrally formed with the lid 14 in one single piece. The flap 50 may have a proximal portion 52 hingedly connected to the brim 34 of the lid 14 by the hinge 58, and an outwardly extending distal portion 54 formed with a plug 56. The plug 56 may be cylindrical in shape. The diameter of the plug 56 can be slightly larger than the diameter of the venting opening 36 such that the plug 56 can be plugged into the vent opening 36 and frictionally held therein to form an air-tight condition in the container 10. The plug 56 may be in any shape that corresponds to the shape of the vent opening 36.

According to the illustrated embodiment, the flap 50 may be very thin and may have a uniform thickness. The flap 50 may have a corrugated shape conforming to the outer shape of the side of the lid 14. The outer surface of the side of the lid 14 may be formed with recesses 82, 86 for receiving therein the flap 50 so that outer surfaces of the flap 50 may flush with outer surfaces of the lid 14 when the flap 50 is at its closed position.

The proximal portion 52 of the flap 50 may have an S-shaped cross section configured to nest on top of the brim 34 of the lid 14 having a matching S-shaped cross section when the flap 50 is at its closed position. The S-shaped proximal portion 52 of the flap 50 may define a U-shaped sealing channel 62 formed adjacent to the hinge 58 and adapted to nest on top of a downwardly facing U-shaped sealing channel 72 of the lid 14 adjacent to the hinge 58, and a U-shaped reinforcing channel 60 adapted to nest on top of the an upwardly facing U-shaped reinforcing channel 70 adjacent to the sidewall 32 of the lid 14 when the flap 50 is at its closed position.

The downwardly facing U-shaped sealing channel 72 may be configured to snap onto the rim 24 of the container body 12 and seal the container 10. The inner wall of the downwardly facing U-shaped sealing channel 72 may be formed with a lip 66 for engagement with the inner wall of the rim 24. The outer wall of the downwardly facing U-shaped sealing channel 72 may be formed with a locking shoulder 68 for locking the outer wall of the rim 24.

The U-shaped reinforcing channel 60 of the flap 50 may be formed with a U-shaped transverse reinforcing bridge or web 64. A plurality of U-shaped transverse reinforcing webs 76 may be formed along the upwardly facing U-shaped reinforcing channel 70 formed around the sidewall 32 of the lid 14. The U-shaped transverse reinforcing web 64 and the plurality of U-shaped transverse reinforcing webs 76 can be used to strengthen the lid 14 so that it cannot be bent or deformed easily.

When a number of lids 14 are stacked one on top of each other, they can be squeezed together and are difficult to separate one from the other. The U-shaped transverse reinforcing webs 64, 76 formed on the lids 14 can prevent a stack of lids 14 from being squeezed together so that they can be separated easily.

Each of the U-shaped transverse reinforcing webs 64, 76 has two upper ends having upwardly diverging curved edges. This design enables the lids 14 to be stacked one on top of the other so that larger quantity of the lids 14 can be placed in a box to save transportation costs. This design also uses less plastic material for manufacturing the lids 14. Thus it helps to save manufacturing costs.

The flap 50 may include a planar portion 80 formed between the proximal and distal portions 52, 54 of the flap 50 and configured to fit in a planar recess 82 formed on the sidewall 32 of the lid 14 when the flap 50 is at its closed position.

The flap 50 may also include an arc portion 84 formed between the planar portion 80 and the distal portion 54 of the flap 50 and configured to fit in an arc-shaped recess 86 formed on an arched portion 88 formed along a top periphery of the lid 14 when the flap is at its closed position.

The distal end 54 of the flap 50 may be provided with a tab 90 disposed in a recessed region 92 formed on the top wall 30 of the lid 14, when the flap 50 is in its closed position, and defining a gap 94 to facilitate the insertion of a finger of a user therein in order to pull out the tab 90 and disengage the plug 56 from the vent opening 36.

Figure 7:
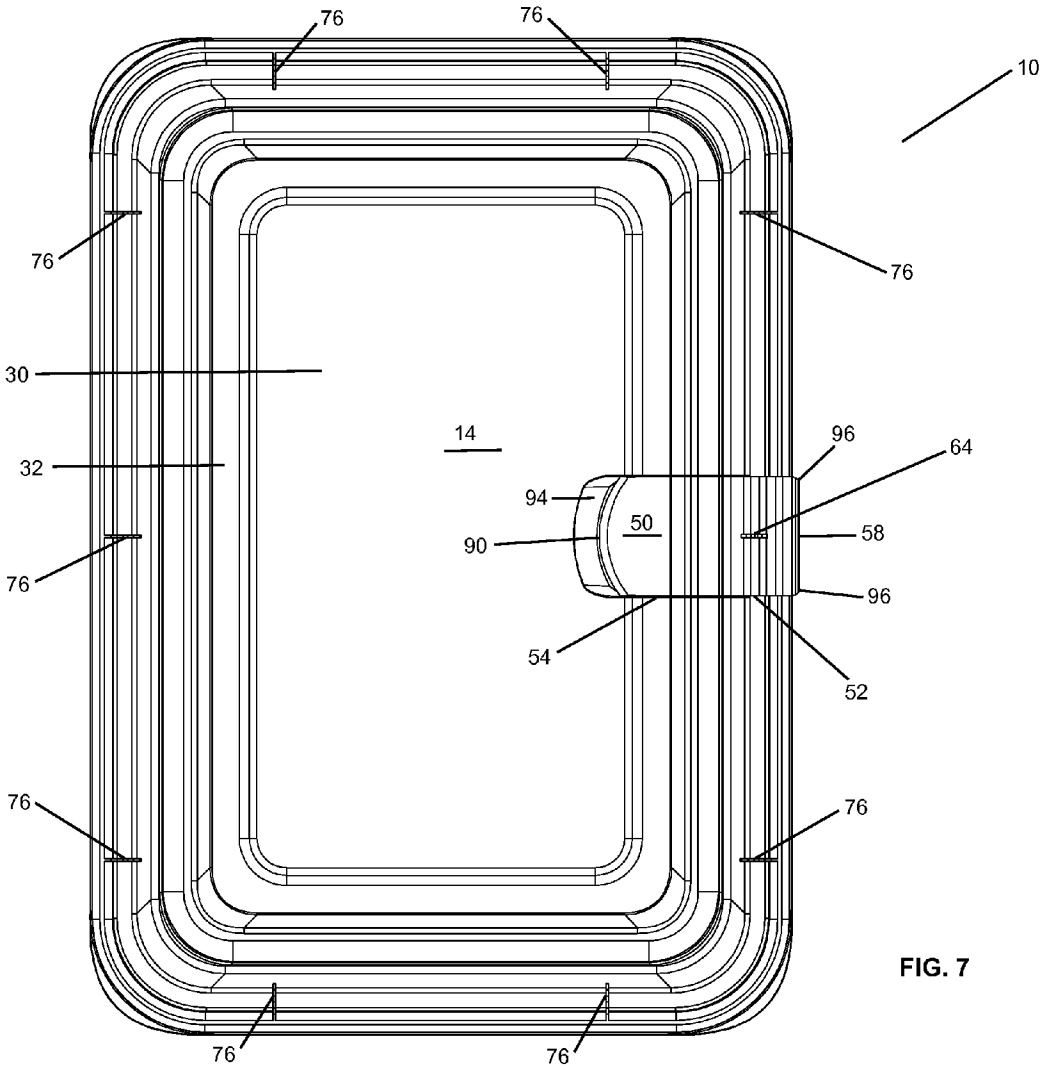
FIG. 7 is a top plan view of the microwave container of FIG. 1 with the flap in a closed position.
Figure 8:
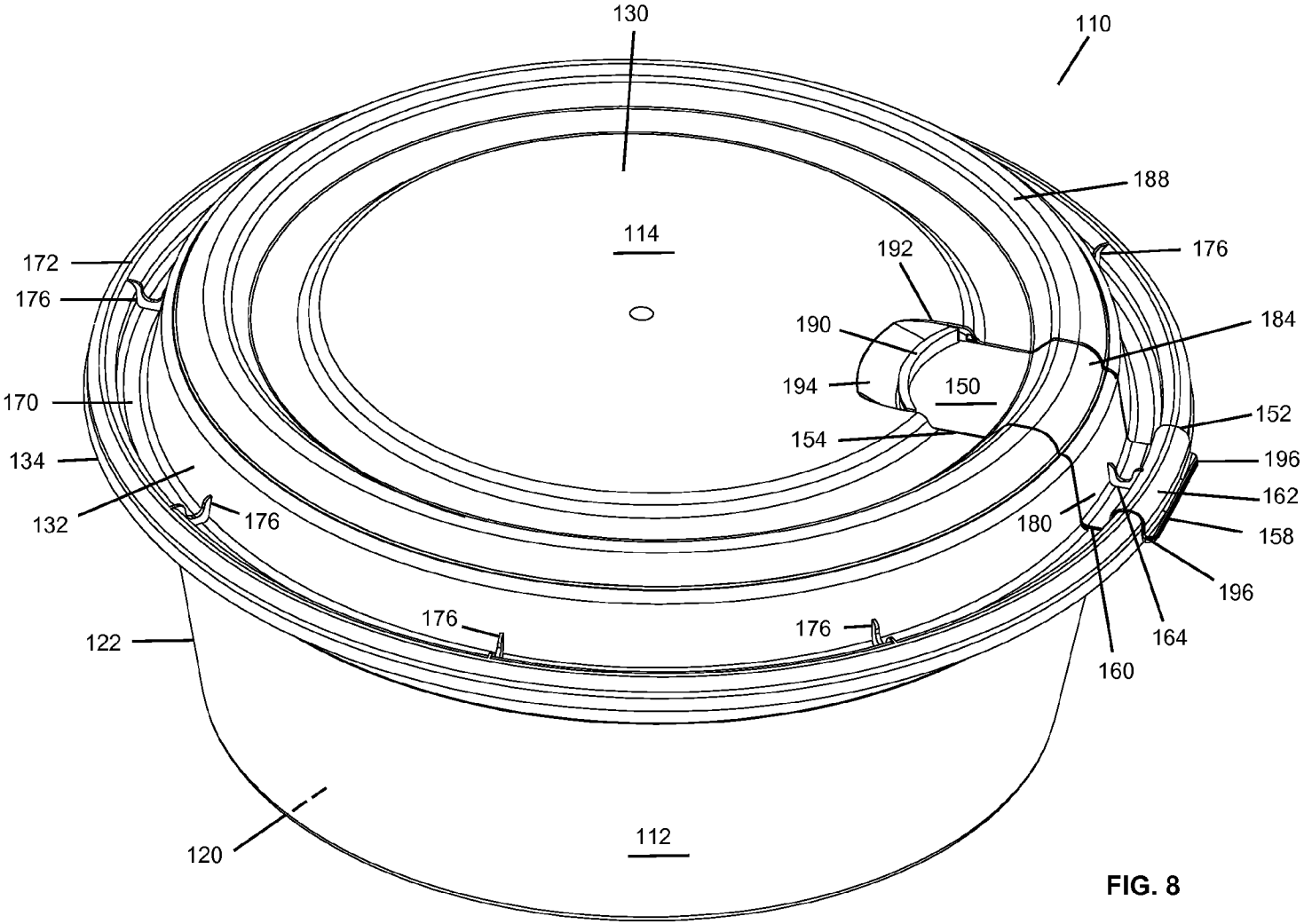
FIG. 8 is a top perspective view of a microwave container according to another embodiment of the present application.
Figure 9:
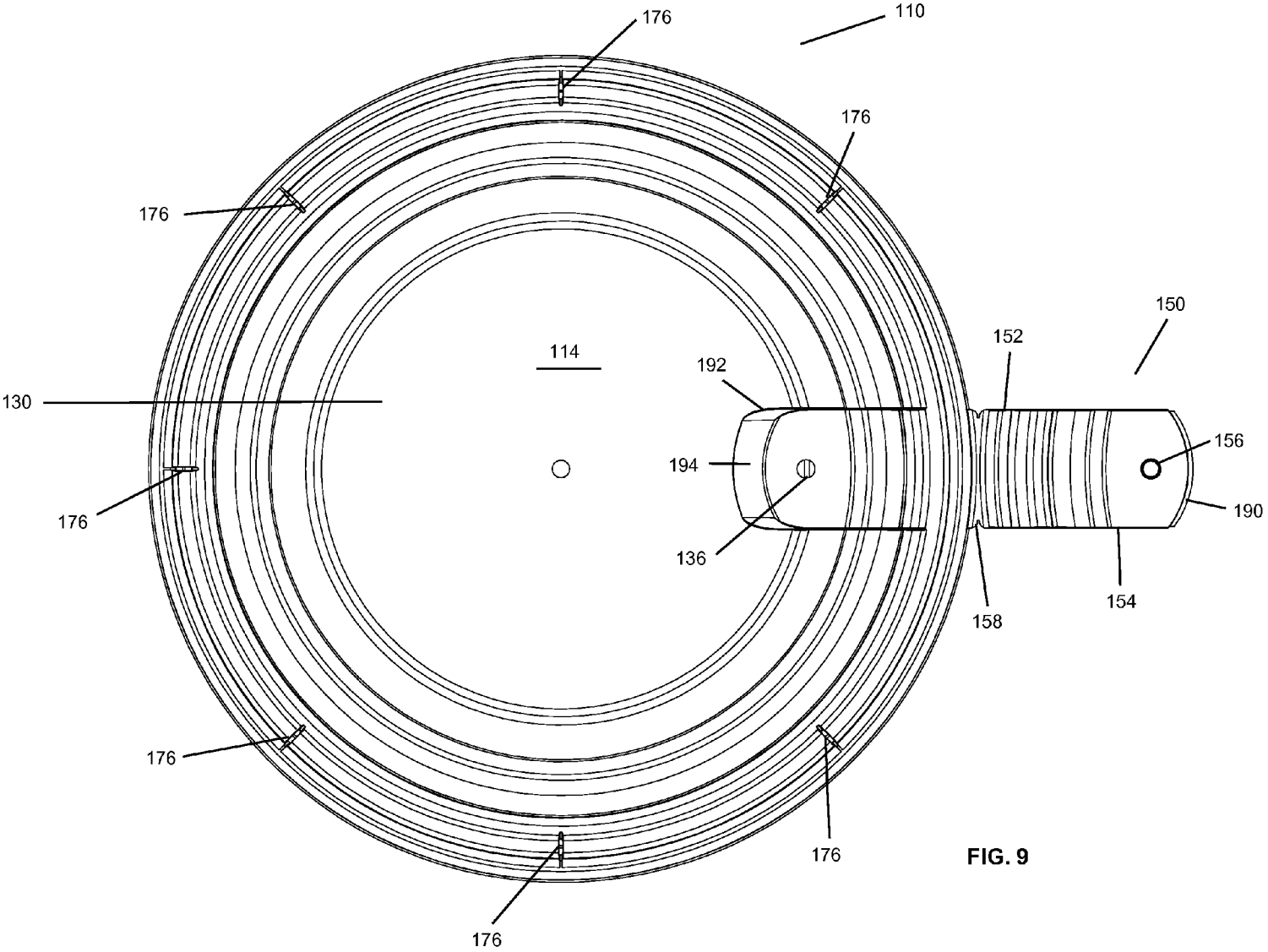
FIG. 9 is a top plan view of the microwave container of FIG. 8 with a flap in a free-hanging position.

As best illustrated in FIG. 7, the living hinge 58 may have a transverse weakened portion about which the hinge 58 can fold, and the folding hinge 58 can have two opposite sides with two rounded corners 96 respectively when the flap 50 is at its closed position. The two rounded corners 96 can avoid scratching, tearing and thus breaking of plastic bags that may be used to hold and carry the container 10 therein. The rounded corners 96 can also prevent possible injury to a user.

The shape of the top wall 30 of the lid 14 can match with the shape of the bottom wall 20 of the container body 12. This allows containers 10 to be securely stacked one on top of the other. The container body 12, the lid 14 with the flap 50 may be made of plastic and may be disposable.

Although it has been shown and described that the vent opening 36 is formed on the top wall 30 of the lid 14, it is understood that the vent opening 36 can be formed on the sidewall 32 of the lid 14. Although it has been shown and described that the lid 14 and the flap 50 are hingedly connected by a living hinge 58 and are integrally formed in one single piece, it is appreciated that the lid 14 and the flap 50 can be formed separately and connected together by any other possible kind of hinge and means.

Although it has been shown that the microwave container 10 has a rectangular container body 12 and a rectangular lid 14, it is understood that the microwave container 10 can be in any other shape such as square, circular, oval, etc.

FIGS. 8-12 are various views of a microwave container 110 according to another embodiment of the present application. According to the illustrated embodiment, the container body 112 and the lid 114 are circular in shape, and the flap 150 can be hingedly connected to a circular brim 134 of the lid 114. The container body 112 may include a bottom wall 120, a sidewall 122 extending upwardly from a periphery of the bottom wall 120 and ending at a rim 124. The lid 114 may include a top wall 130, a sidewall 132 extending downwards from a periphery of the top wall 130 and ending at a brim 134. The top wall 130 can be formed with a vent opening 136. The vent opening 136 may be circular in shape.

A flap 150 can be integrally formed with the lid 114 in one single piece. The flap 150 may have a proximal portion 152 hingedly connected to the brim 134 of the lid 114 by a living hinge 158, and an outwardly extending distal portion 154 formed with a plug 156. The plug 156 may be cylindrical in shape. The diameter of the plug 156 can be slightly larger than the diameter of the venting opening 136 such that the plug 156 can be plugged into the vent opening 136 and frictionally held therein to form an air-tight condition in the container 110.

The flap 150 may be hingedly connected to the brim 134 of the lid 114 by the living hinge 158. The flap 150 can be movable between a free-hanging position, as depicted in FIG. 2, where the flap 150 is hanging freely from the brim 134 of the lid 114 and a closed position, as depicted in FIG. 1, where the flap 150 is flipped about the living hinge 158 over a side of the lid 114 and the plug 156 is plugged into the vent opening 36 on the lid 114.

According to the illustrated embodiment, the flap 150 may be very thin and may have a uniform thickness. The flap 150 may have a corrugated shape conforming to the outer shape of the side of the lid 114, and a curvature conforming to the circular shape of the lid 114. The outer surface of the lid 114 may be formed with recesses 182, 186 for receiving therein the flap 150 so that outer surfaces of the flap 150 may flush with outer surfaces of the lid 114 when the flap 150 is at its closed position.

The proximal portion 152 of the flap 150 may have an S-shaped cross section configured to nest on top of the brim 134 of the lid 114 having a matching S-shaped cross section when the flap 150 is at its closed position. The S-shaped proximal portion 152 of the flap 150 may define a U-shaped sealing channel 162 formed adjacent to the living hinge 158 and adapted to nest on top of a downwardly facing U-shaped sealing channel 172 of the lid 114 adjacent to the living hinge 158, and a U-shaped reinforcing channel 160 adapted to nest on top of the an upwardly facing U-shaped reinforcing channel 170 adjacent to the sidewall 132 of the lid 114 when the flap 150 is at its closed position.

The U-shaped reinforcing channel 160 of the flap 150 may be formed with a U-shaped transverse reinforcing bridge or web 164. A plurality of U-shaped transverse reinforcing web 176 may be formed around the upwardly facing U-shaped reinforcing channel 170 of the lid 114. The U-shaped transverse reinforcing web 164 and the plurality of U-shaped transverse reinforcing web 176 may extend radially from a center of the circular lid 114. Each of the U-shaped transverse reinforcing webs 164, 176 may have two upper ends having upwardly diverging curved edges.

The flap 150 may include a generally planar portion 180 formed between the proximal and distal portions 152, 154 of the flap 150 and configured to fit in a generally planar recess 182 formed on the sidewall 132 of the lid 114 when the flap 150 is at its closed position.

The flap 150 may further include an arc portion 184 formed between the planar portion 180 and the distal portion 154 of the flap 150 and configured to fit in an arc-shaped recess 186 formed on an arched portion 188 formed along a top periphery of the lid 114 when the flap is at its closed position.

The distal end 154 of the flap 150 may be provided with a tab 190 disposed in a recessed region 192 formed on the top wall 130 of the lid 114, when the flap 150 is in its closed position, and defining a gap 194 to facilitate the insertion of a finger of a user therein in order to pull out the tab 190 and disengage the plug 156 from the vent opening 136.

Figure 10:
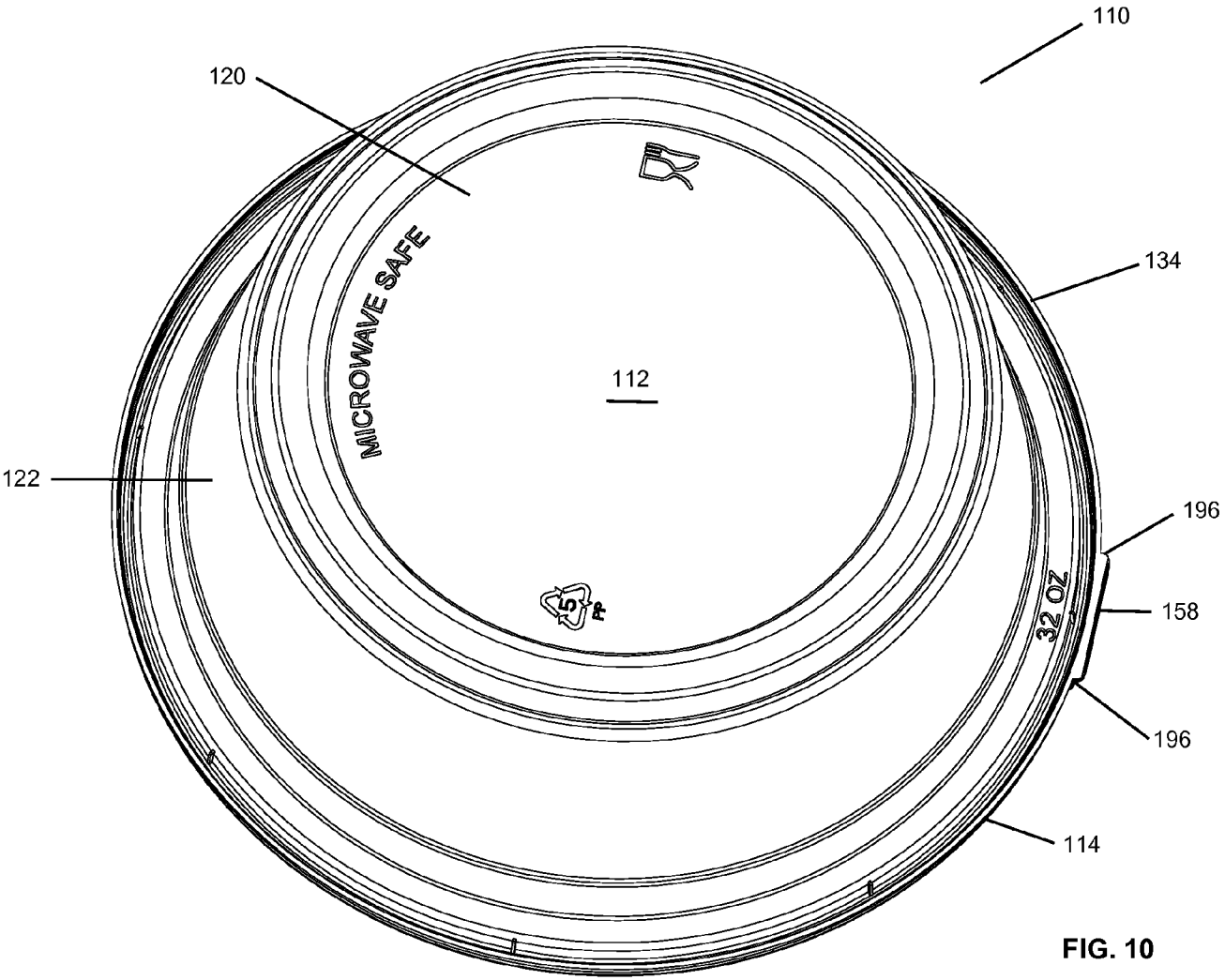
FIG. 10 is a bottom perspective view of the microwave container of FIG. 8 with the flap in a closed position.
Figure 11:
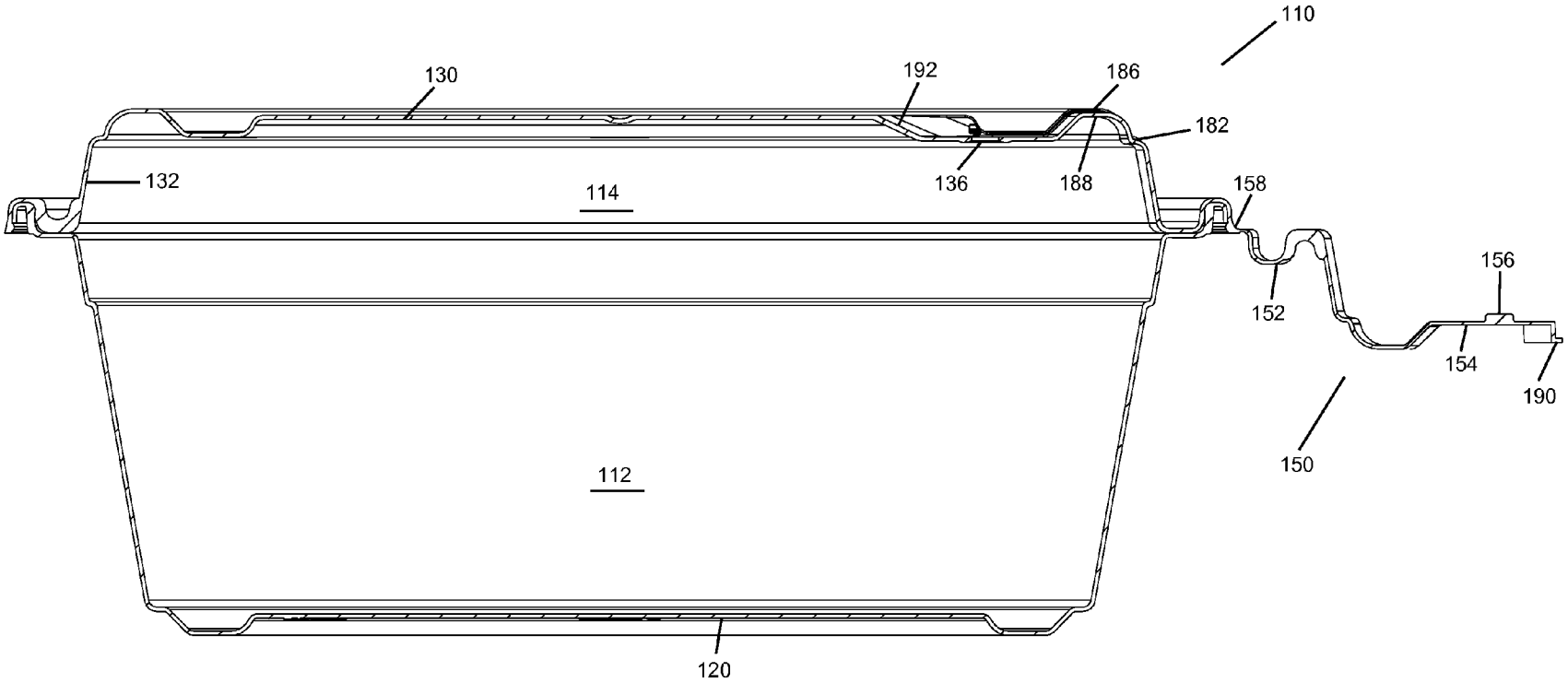
FIG. 11 is a cross sectional view of the microwave container of FIG. 8 with the flap in a free-hanging position.
Figure 12:
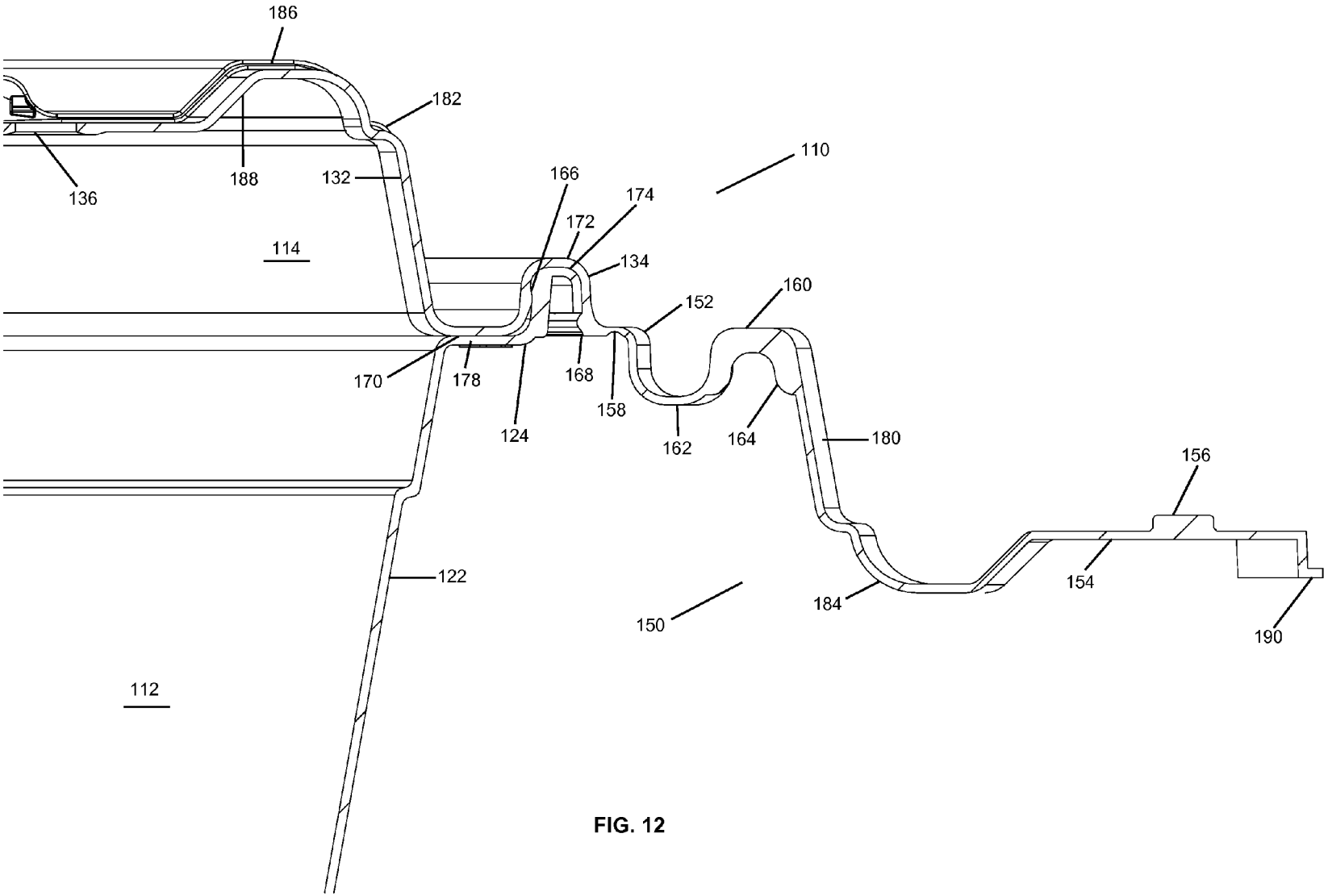
FIG. 12 is an enlarged cross sectional view of the microwave container of FIG. 11.

As best illustrated in FIG. 10, the living hinge 158 may have a transverse weakened portion about which the hinge 158 can fold, and the folding hinge 158 may have two opposite sides with two rounded corners 196 respectively when the flap 150 is at its closed position.

While the microwave container disclosed in the present application has been shown and described with particular references to a number of preferred embodiments thereof, it should be noted that various other changes or modifications may be made without departing from the scope of the appending claims.

What is claimed is:

1. A microwave container comprising:

(a) a container body having a bottom wall, a sidewall extending upwardly from a periphery of the bottom wall and ending at a rim;

(b) a lid having a top wall, a sidewall extending downwardly from a periphery of the top wall and ending at a brim, the lid being formed with a vent opening; and (c) a corrugated flap having a proximal portion hingedly connected to the brim of the lid by a living hinge and an outwardly extending distal portion formed with a plug, wherein the flap is movable between a free-hanging position where the flap is hanging freely from the brim of the lid and a closed position where the flap is flipped about the living hinge over a side of the lid and the plug is plugged into the vent opening;

wherein the proximal portion of the flap comprises an S-shaped portion comprising a U-shaped sealing channel disposed adjacent to the hinge and configured to nest snugly on top of a downwardly facing U-shaped sealing channel of the brim of the lid adjacent to the hinge, and a U-shaped reinforcing channel configured to nest snugly on top of an upwardly facing U-shaped reinforcing channel of the brim of the lid adjacent to the sidewall thereof when the flap is at its closed position;

wherein the flap comprises a planar portion extending from the U-shaped reinforcing channel, and configured to fit snugly within a planar recess formed on the sidewall of the lid in such a manner that the outer surface of the planar portion of the flap is flush with adjacent outer surfaces of the lid when the flap is at its closed position;

wherein the flap further comprises an arc portion extending from the planar portion, and configured to fit snugly within an arc-shaped recess formed on an arched portion formed along the top periphery of the lid in such a manner that the outer surface of the arc portion of the flap is flush with adjacent outer surfaces of the lid when the flap is at its closed position;

wherein the distal portion of the flap is formed with a tab configured to fit snugly in a recessed region formed on the top wall of the lid when the flap is at its closed position, and defining a gap to facilitate the insertion of a finger of a user therein in order to pull out the tab and disengage the plug from the vent opening; and wherein the flap and the lid are formed integrally in one single piece, and the entire flap has a corrugated shape conforming to the side of the lid so that when the flap is flipped to the closed position the entire flap fits snugly to and abuts against the side of the lid without protruding out from the lid and without forming any gap between the flap and the lid.

2. The container as claimed in claim 1, wherein the living hinge has a transverse weakened portion about which the hinge folds, and the folding hinge has two opposite sides with two rounded corners respectively.

3. The container as claimed in claim 1, wherein the U-shaped reinforcing channel of the flap is integrally formed with a U-shaped transverse reinforcing web with two upper ends having upwardly diverging curved edges.

4. The container as claimed in claim 1, wherein the upwardly facing U-shaped reinforcing channel of the brim of the lid is integrally formed with a plurality of U-shaped transverse reinforcing web with two upper ends having upwardly diverging curved edges.

5. The container as claimed in claim 1, wherein the container body and the lid are rectangular in shape, and the flap is hingedly connected to one side of a rectangular brim of the lid.

6. The container as claimed in claim 1, wherein the container body and the lid are circular in shape, and the flap is hingedly connected to a circular brim of the lid.

* * * * *